US006748908B2

(12) United States Patent
Freiheit

(10) Patent No.: US 6,748,908 B2
(45) Date of Patent: Jun. 15, 2004

(54) THERMAL EXHAUST THROTTLE

(76) Inventor: Roger E. Freiheit, 3124 S. 12th, Tacoma, WA (US) 98405

( * ) Notice: Subject to any disclaimer, the term of this patent is extended or adjusted under 35 U.S.C. 154(b) by 48 days.

(21) Appl. No.: 10/269,101

(22) Filed: Oct. 9, 2002

(65) Prior Publication Data

US 2003/0101948 A1 Jun. 5, 2003

Related U.S. Application Data

(60) Provisional application No. 60/328,391, filed on Oct. 9, 2001.

(51) Int. Cl.[7] ..... F01N 7/00
(52) U.S. Cl. ..... 123/65 PE; 60/324
(58) Field of Search ..... 123/65 PE, DIG. 3, 123/179.27, 65 A, 65 P, 65 SP, 65 V, 323, 65 VA, 337; 60/324

(56) References Cited

U.S. PATENT DOCUMENTS 2,806,458 A * 9/1957 Mettetal ..... 123/65 V
2,921,568 A * 1/1960 Mettetal ..... 123/337
2,940,434 A * 6/1960 Stanzel ..... 123/334
3,369,531 A * 2/1968 Harold ..... 123/65 V
6,053,146 A * 4/2000 Arlton et al. ..... 123/323

* cited by examiner

*Primary Examiner*—Tony M. Argenbright
*Assistant Examiner*—Hyder Ali
(74) *Attorney, Agent, or Firm*—Seed IP Law Group PLLC

(57) ABSTRACT

An exhaust throttling system for engines having individual cylinders with at least one exhaust port to exhaust combustion gases from the cylinder chamber, the system including at least one sleeve configured to be slidably attached to the cylinder and selectively cover and uncover the exhaust port, the at least one sleeve formed of a metal having a coefficient of thermal expansion greater than the coefficient of thermal expansion of the cylinder to expand and contract in response to changes in temperature and change dimension of a gap between the at least one sleeve and the cylinder to change the rate of blowby of exhaust gases.

19 Claims, 7 Drawing Sheets

THERMAL EXHAUST THROTTLE

BACKGROUND OF THE INVENTION

1. Field of the Invention

The present invention pertains to speed control mechanisms for miniature engines, and more particularly to an exhaust throttle for a miniature thermal engine, such as are used on radio-controlled model aircraft and cars.

2. Description of the Related Art

Miniature thermal engines have been developed for use in propelling model craft, such as aircraft, boats, and wheeled vehicles. Remote control of these model craft is achieved by hand-held radio transmitters used in conjunction with receivers and servos mounted in the model craft. This provides for control of a number of functions, including speed and directional control.

Various designs have been employed in controlling the speed of miniature engines. The most common method involves an engine throttle controlled by a single servo actuator. In some designs, the throttle is a variable port that changes size to control fuel or air or a mixture of fuel and air flowing into the engine. In another design, the size of an exhaust opening is increased and decreased for respective control of the engine speed.

A typical exhaust throttle design includes a cylindrical sleeve placed over the piston cylinder of the engine. The piston cylinder has an exhaust opening that is sized to allow exhaust to flow out of the piston cylinder at a maximum speed. The throttle sleeve has a corresponding opening formed in its side wall that is rotated into and out of alignment with the exhaust opening. When the throttle sleeve opening is fully aligned with the exhaust port, maximum engine speed (measured in revolutions per minute or RPM) is achieved. Proportional restriction of the exhaust opening results in a corresponding reduction in engine RPM.

Although this prior exhaust throttle design has been adequate for its purpose, it has the disadvantage of unnecessarily restricting the exhaust opening when in the fully aligned position. It also does not provide for adjustment in the size of the opening in the exhaust throttle sleeve. Moreover, very small engines, such as a 0.010 cubic inch displacement single-piston engine using an air bleed carburetor for throttling will have an idle of up to 14,000 rpm in some cases. Heretofore, no control systems have been devised that can achieve an idle speed much lower than the 14,000 rpm range in the 0.010 size of single-piston engines.

BRIEF SUMMARY OF THE INVENTION

The disclosed and claimed embodiments of the invention are directed to a control system for a miniature engine having individual cylinders with at least one exhaust port to exhaust gases from the cylinder that achieves controlled speed range of 6,000 rpm on idle to 30,000 rpm on full speed.

In accordance with one embodiment of the invention, the control system includes at least one sleeve configured to attach to the cylinder and selectively cover and uncover the exhaust port, the sleeve formed of a metal material having a coefficient of thermal expansion greater than the coefficient of thermal expansion of the material of the cylinder to expand and contract in response to increases and decreases in temperature, respectively, of the cylinder and exhaust gases, thereby changing dimensions of a gap between the cylinder and the sleeve to thereby change the rate of blow-by of the exhaust gases through the gap, to thereby control the speed of the engine.

In accordance with another aspect of the invention, the sleeve is formed from two plates or semi-sleeves, each semi-sleeve having a central portion and first and second fastener wings depending from first and second sides thereof, respectively, and an exhaust vent formed in each of the first and second fastener wings.

In accordance with yet another aspect of the invention, first and second doubler plates sized and shaped to match the first and second fastener wings are attached to the first and second fastener wings.

In accordance with a method of the present invention, at least one sleeve is formed of a material having a greater coefficient of thermal expansion than the coefficient of thermal expansion of an engine cylinder; the at least one sleeve is attached to a cylinder having an exhaust port for movement around the cylinder; the sleeve is rotated on the cylinder to uncover the exhaust port for high-speed operation of the engine, and to cover the exhaust port for idle operation wherein the at least one sleeve expands and contracts in response to increases and decreases in the cylinder temperature, respectively, to alter the dimension of a gap between the at least one sleeve and the cylinder to change the amount of blow-by of exhaust gases between a gap, thereby automatically regulating the speed of the engine.

BRIEF DESCRIPTION OF THE SEVERAL VIEWS OF THE DRAWING(S)

The features and advantages of the disclosed embodiment of the invention will be more readily appreciated as the same become better understood from the following detailed description of a representative embodiment when taken in conjunction with the accompanying drawings, wherein.

DETAILED DESCRIPTION OF THE INVENTION

Figure 1:
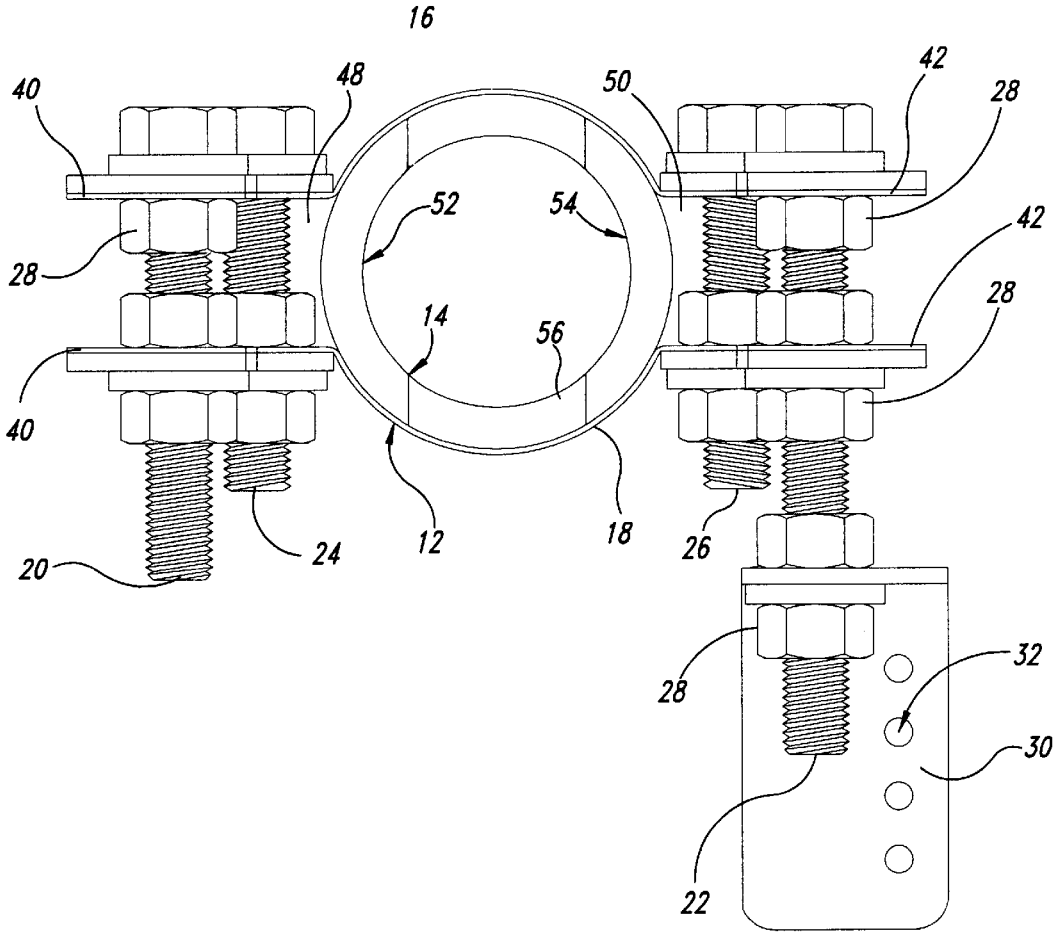
FIG. 1 is a top view of the exhaust throttle mounted to an engine cylinder in accordance with the present invention.

In accordance with one embodiment of the invention, a proportional exhaust throttle 10 is provided. The proportional exhaust throttle 10 includes a rigid, yet bendable, collar 12 that is sized and shaped to be slidably received around a piston cylinder 14, as shown in FIG. 1. The collar 12 is formed of first and second semi-sleeves 16, 18 held together by a first pair of top fasteners 20, 22 and a second pair of bottom fasteners 24, 26. Ideally, the four fasteners 20, 22, 24, and 26 comprise machine screws that are held in place by brass nuts 28. A linear control horn 30 is attached to the screw 22 that is the longest of the four screws. The linear control horn 30 includes a plurality of openings 32 spaced equidistantly apart for the connection of an output arm or wheel on a throttle servo (not shown).

Figure 2:
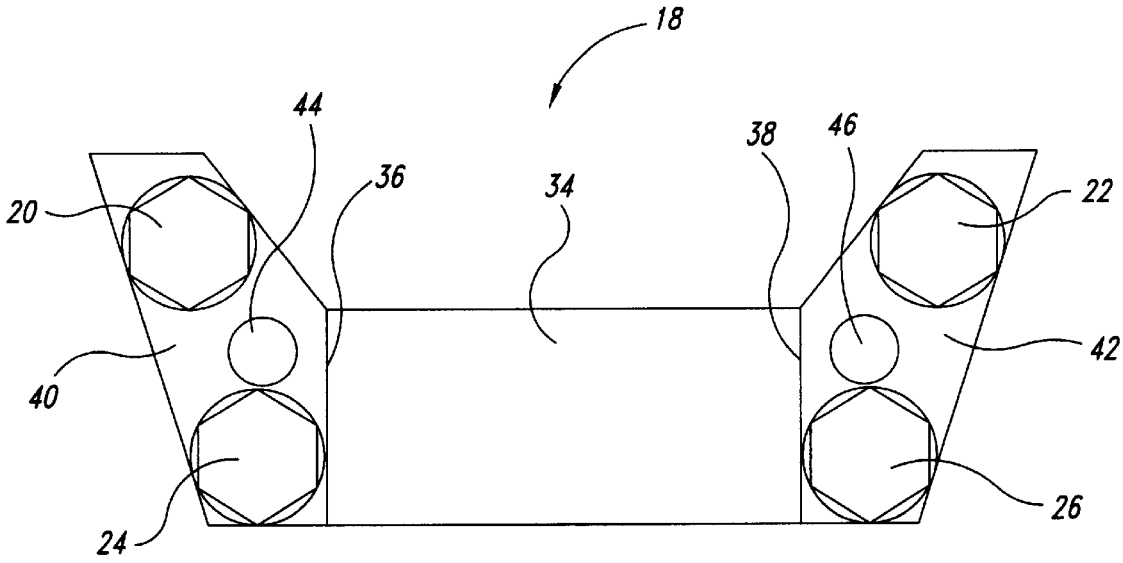
FIG. 2 is a side view of an exhaust throttle semi-sleeve formed in accordance with the present invention.

Referring to FIG. 2, shown therein is a side view of a semi-sleeve 18. In this embodiment, the semi-sleeve 18 has a substantially rectangular-shaped central section having first and second ends 36, 38 from which depend first and second fastener horns 40, 42, respectively. An exhaust vent 44, 46 is formed in each of the first and second fastener horns 40, 42, respectively. Openings (not shown) are also formed in the fastener horns 40, 42, for the four fasteners 20, 22, 24, 26.

Figure 3:
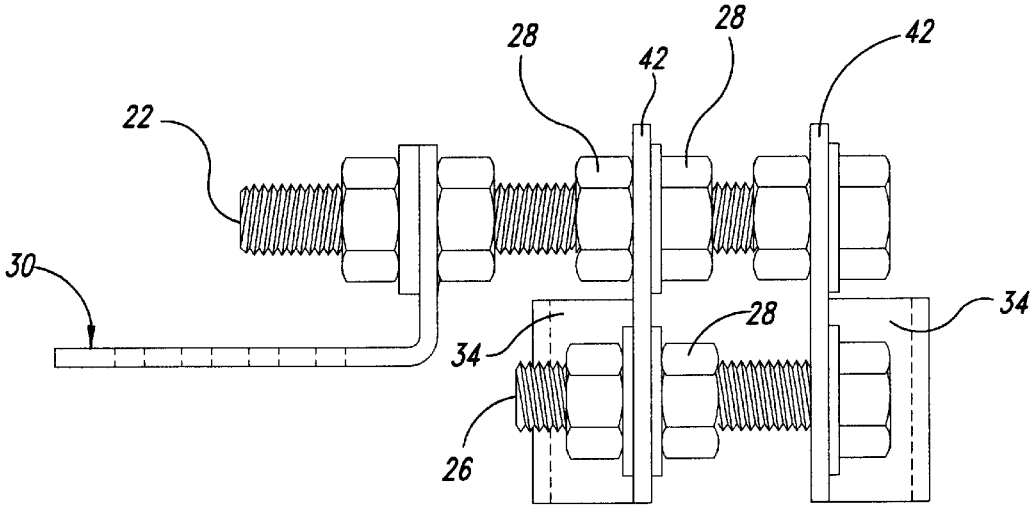
FIG. 3 is a side view of the exhaust throttle of FIG. 1.

It should be noted that while this particular embodiment of the invention as shown in FIGS. 1–3 includes dimensions that are sized to accommodate an engine of 0.010 size, the present invention can be adapted to fit engines of other sizes by varying the dimensions, as will be known to those skilled in the art.

The central section 34 of each semi-sleeve 16, 18 is formed to have an arcuate shape to match the radius of the outside diameter of the piston cylinder 14 as shown in FIG. 1. Each fastener horn 40, 42 is bent about the first and second sides 36, 38 of the central section 34 to extend outward in the same plane.

The arcuate-shaped semi-sleeves 16, 18 are held to opposing sides of the piston cylinder 14 by the four screws 20, 22, 24, 26. When so mounted to the piston cylinder 14, the pair of semi-sleeves 16, 18 form the collar 12 that rotates around the piston cylinder 14 to function as a proportional throttle. The space between the pair of parallel-mounted fastener horns 40 define an adjustable exhaust port 48 on one side of the piston cylinder 14, and the parallel-mounted fastener horns 42 form a second exhaust port 50 on an opposing side of the piston cylinder 14.

The piston cylinder 14 includes first and second exhaust openings 52, 54 formed in its sidewall 56. More particularly, the first exhaust opening 52 is defined as the arcuate segment between points A and B, while the second opening 54 is defined by the arcuate segment formed between the points C and D, as shown in FIG. 1. Thus, with the throttle 10 positioned as shown in FIG. 1, the first exhaust port 48 is aligned with the first opening 52 in the piston cylinder 14, and the second exhaust port 50 formed by the second pair of horns 42 is aligned with the second opening 54 and the piston cylinder 14.

Rotation of the throttle 12 is accomplished by movement of a pushrod (not shown) attached to the linear control horn 30 such that the collar 12 rotates clockwise and counter-clockwise as shown in the top view of FIG. 1. Macro adjustment of the rotation of the collar 12 is accomplished by moving the pushrod from one hole 32 to the next to increase or decrease the degrees of rotation of the collar 12, is illustrated by the arrows in FIG. 1. Micro rotation adjustment or very fine throttle rotation adjustments are accomplished by loosening the nuts 28 on the long screw 22 and sliding the linear control horn 30 along the screw 22 to increase or decrease throttle rotation.

Adjustment in the size of the exhaust ports 48, 50 is accomplished by bending the fastener horns 40 and 42 closer to the counterpart fastener horns 40, 42. This can be accomplished by rotating the brass nuts 28. In a preferred embodiment, adjustment to the size of the exhaust ports 48, 50 is made by rotating and moving the brass nuts 28 on the first pair of screws 20, 22, while adjustment in the tightening of the collar 12 to the cylinder 14 is made by rotating the nuts 28 on the bottom fasteners 24, 26.

Ideally, each semi-sleeve 16, 18 is formed of material having a greater co-efficient of thermal expansion than the cylinder, such as brass, as are the fasteners 20, 22, 24, 26 and the nuts 28.

In use, the exhaust vents 44, 46 provide an unrestricted exhaust pathway between the pairs of fastener horns 40, 42. These vents 44 in combination with the adjustable exhaust ports 48, 50 eliminate the considerable loss of top-end RPM that is experienced with non-adjustable or fixed ports. Thus, highest top-end RPM is reached when the collar's exhaust ports 48, 50 are aligned with the exhaust openings 52, 54 in the piston cylinder 14.

The exhaust ports 48, 50 are adjustable in width by unlocking and rotating the four top fastener nuts 28 between the fastener horns 40 and the fastener horns 42. The closer the pair of fastener horns 40 are urged together by the nuts 28, the smaller the exhaust port 48 will be. To maintain the width or size of the exhaust port 48, the pair of fastener horns 40 are locked into place by all of the nuts being tightened on both sides of the fastener horns 40. The same applies to the pair of fastener horns 42 that form the other exhaust port 50.

An even larger change in the size of the exhaust ports 48, 50 can be made by rebending the flexible semi-sleeves 16, 18 to lengthen or shorten the distance between the bend lines formed at the sides 36, 38 of the central section 34. It is to be understood that rebending of the semi-sleeves 16, 18 will change the width of the fastener horns. To reduce the size of the exhaust ports 48, 50, the bend lines are formed on the outside of the edges 36 and 38 of the central section 34, and vice versa. However, owing to the adjustability in the positioning of the fastener horns 40, 42, it is unlikely that such adjustments in the bend lines would ever have to be made for optimum throttle performance. "Blowby"is exhaust that escapes under the semi-sleeves 16, 18 rather than through the exhaust ports 48, 50. In other words, a gap between the semi-sleeves 16, 18 and the cylinder 14 permits exhaust gases from the engine to pass to the outside even though the semi-sleeves 16, 18 are covering the exhaust openings 52, 54 in the cylinder 14. The bottom pair of fasteners 24, 26, are designed to be used to tighten the collar 12 on the piston cylinder 14 to reduce blowby for the lowest idle. The top fasteners 20, 22 can be used for this same purpose, although to a lesser degree. The fit of the collar 12 is within tolerance when the collar 12 can be rotated to a position that will stop the engine, i.e., in a position where the semi-sleeves 16 have their central sections 34 substantially covering the exhaust openings 52, 54 in the piston cylinder 14. This ability will allow the user to prevent engine damage if the engine happens to go lean (inadequate lubrication) during operation by enabling the user to stop the engine.

As described above, the linear control horn 30 has several holes 32 that can be used for connection of a pushrod. The closer the pushrod connection is made to the piston cylinder 14, the greater the degree of rotation of collar 12 will experience with corresponding movement of the pushrod; and conversely, the farther the pushrod connection is made on the linear control horn 30 from the piston cylinder 14, the fewer the degrees of rotation of the collar 12 will be achieved with corresponding movement of the pushrod.

Also, as previously described, linear movement of the control horn 30 along the longitudinal axis of the screw 22 is accomplished by loosening the nuts 28. For any invariable amount of pushrod travel, moving the horn 30 closer to the piston cylinder increases the degrees of rotation of the throttle collar 12, and, conversely, moving the horn 30 farther away from the piston cylinder 14 decreases the degrees of rotation of the throttle collar 12.

The proportional exhaust throttle 10 can be adjusted for mid-range RPM control by approximately sixty (60) degrees of rotation of the throttle collar 12. This is accomplished through the macro and micro adjustments at the throttle, as described above, and the pushrod connecter adjustments at the wheel of a throttle servo. With one or more of these adjustments, throttle sleeve rotation can be limited to approximately sixty (60) degrees. For example, in model aircraft, when a transmitter's throttle stick is moved from a full down (idle) to a full-up (full speed) position, the travel is ideally set at sixty (60) degrees for the rotation of the throttle collar 12. With adjustment made in this manner, the throttle collar 12 has a wide mid-range adjustment with a smooth, progressive and fully variable change of engine RPM with any movement of a transmitter's throttle stick.

In construction, metals with different coefficients of thermal expansion can be used to optimize idle and top-end RPM and to reduce the throttle servo load. The coefficient of linear expansion of a brass semi-sleeve at 0° C. is $19\times10^{-6}$; and the coefficient of volume expansion at 0° C. is $56\times10^{-6}$. The coefficient of linear expansion of the steel piston cylinder 14 at 0° C. is $11\times10^{-6}$, with a coefficient of volume expansion being at $33\times10^{-6}$. Therefore, for any rise in temperature, the brass semi-sleeves will experience thermal expansion at approximately 70% greater rate than the thermal expansion of the steel piston cylinder 14. Conversely, for any fall in temperature, the brass semi-sleeves 16, 18 will experience thermal contraction that will be approximately 70% greater than the thermal contraction of the steel piston cylinder 14. This natural difference in thermal expansion or contraction of solids acts to automatically enhance throttle performance. Moreover, the higher the engine's operating temperature, the greater will be the difference in the comparative sizes of the brass semi-sleeves 16, 18 and the steel piston cylinder 14. Therefore, with the engine running at full speed and at highest operating temperature, the collar 12 will have the loosest fit for minimum servo load and maximum "blowby" for optimum top-end RPM. When the engine is running on idle at a lowest operating temperature, there is the least change in the proportionate sizes of the brass semi-sleeves 16, 18 and the steel piston cylinder 14. Therefore, the collar 12 will fit with a relatively snug fit, which reduces exhaust "blowby" for optimum idle RPM.

Before the engine runs, the throttle collar 12 is adjusted so that the collar 12 fit is fairly tight, but not so tight that it will bind or stall the throttle servo. At engine and throttle operating temperatures, from full idle to full speed, the throttle collar 12 becomes looser on the piston cylinder 14, which reduces servo load, as mentioned above. Most noteworthy, however, is that the thermal exhaust throttling of the present invention produces substantially higher top-end RPM than achieved with conventional exhaust throttling or carburetor throttling, that use a restricted venturi, which reduces top-end RPM to increase suction and fuel draw for a reliable idle.

Thus, for open throttle or full speed operation, the throttle collar 12 is rotated so the exhaust ports 48, 50 are aligned with the ported sections or exhaust openings 52, 54 of the piston cylinder 14. For closed throttle and idle performance, the throttle collar 12 is rotated until the exhaust ports 48, 50 are aligned with the non-ported sections of the piston cylinder 14. Fully variable midrange RPM performance is achieved by rotating the throttled collar 12 clockwise and counterclockwise to respectively and progressively open and close the exhaust openings 52, 54 and the piston cylinder 14 for a smooth change of RPM. Engine stoppage is accomplished by rotating the collar 12 until the ported exhaust openings 52, 54 and the piston cylinder 14 are completely closed by the central sections 34 of each semi-sleeve 16, 18. It may also be necessary, in order to stop the engine, to adjust the fastener horns 40, 42 to reduce the exhaust blowby.

Figure 4A:
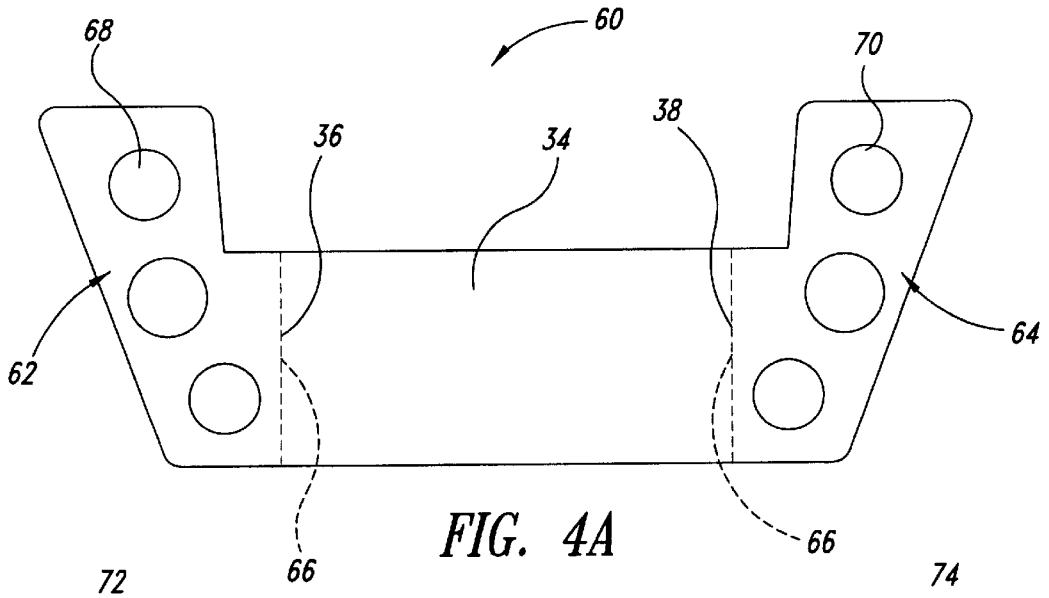
FIGS. 4A–4C are side views of a semi-sleeve, a wing doubler, and the semi-sleeve with wing doubler attached thereto in accordance with another embodiment of the invention.
Figure 4B:
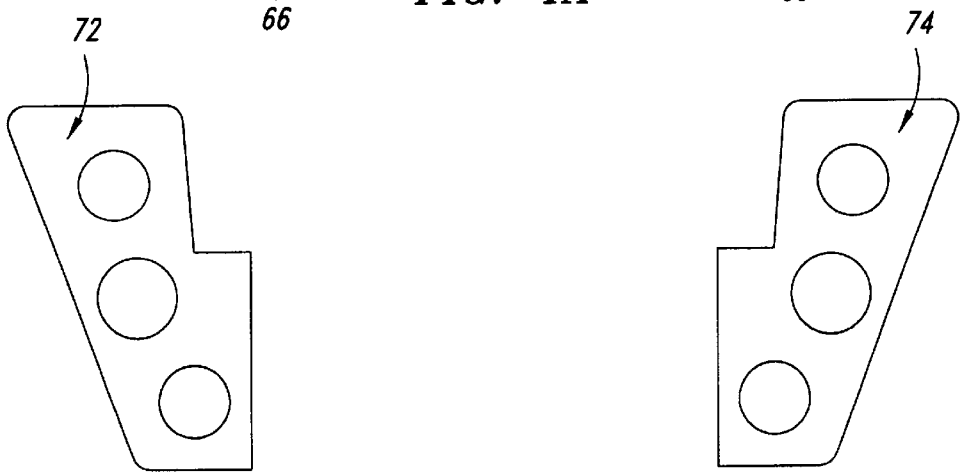
Figure 4C:
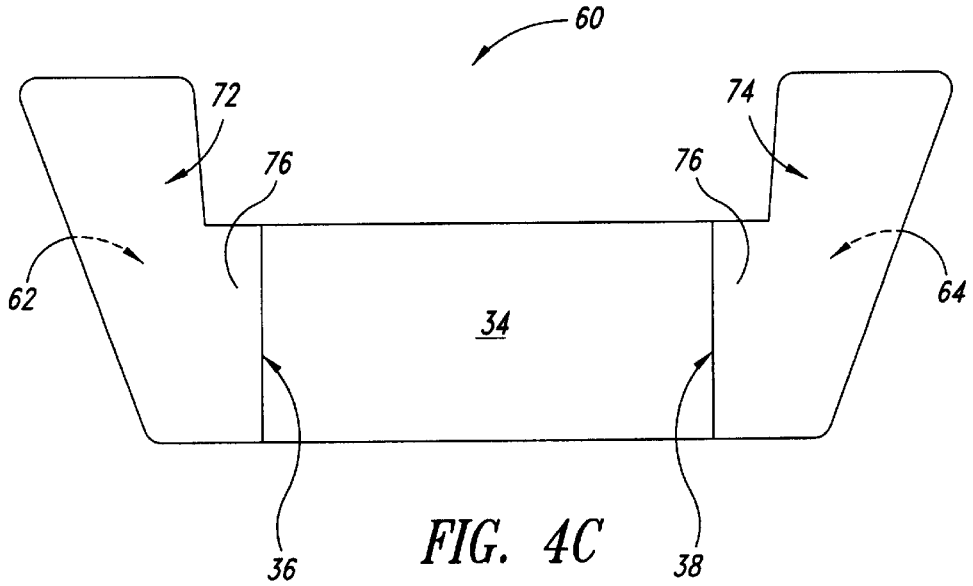
Figure 5:
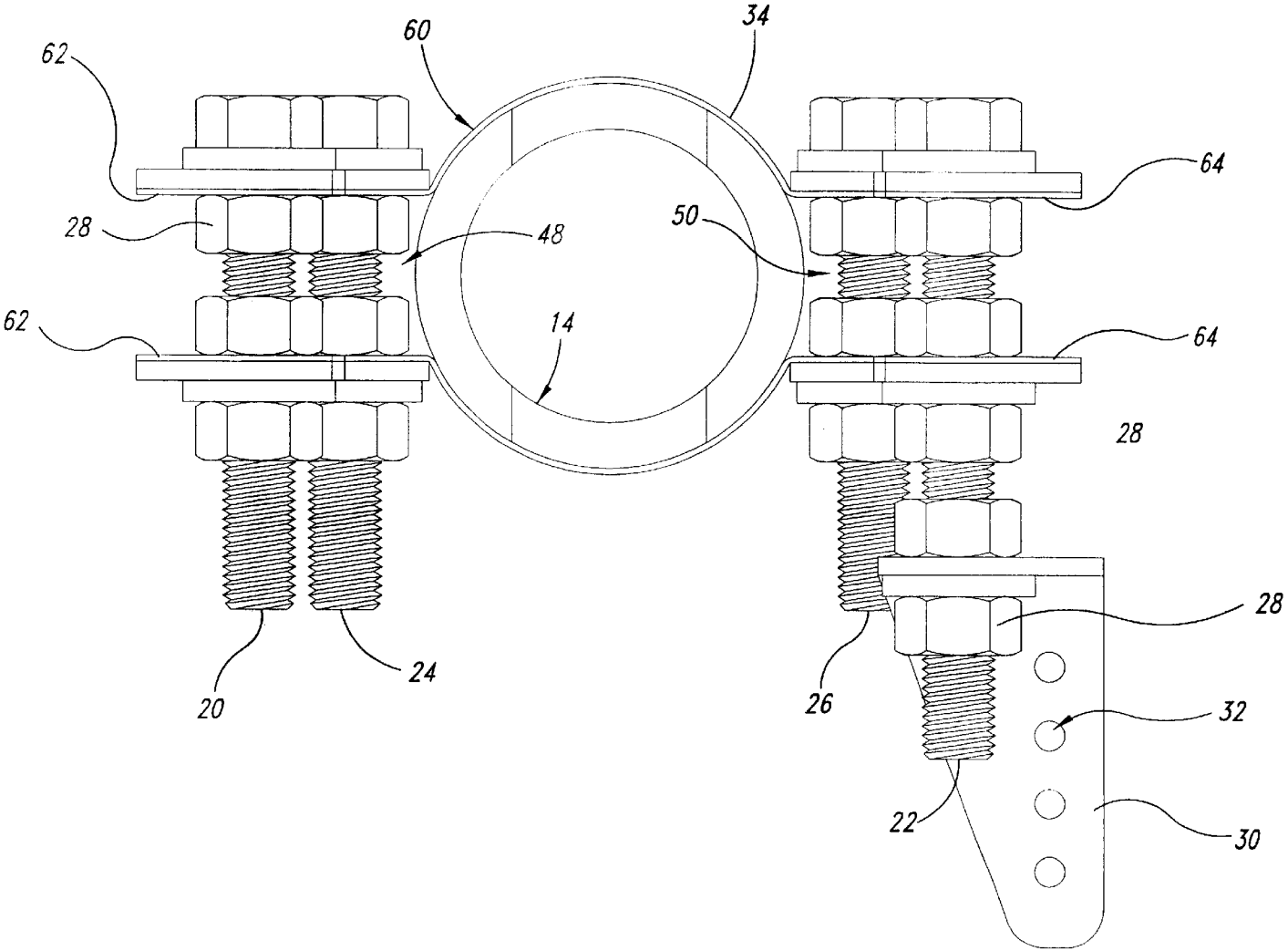
FIG. 5 is a top view of the exhaust throttle in accordance with the second embodiment of the invention mounted to an engine cylinder.
Figure 6:
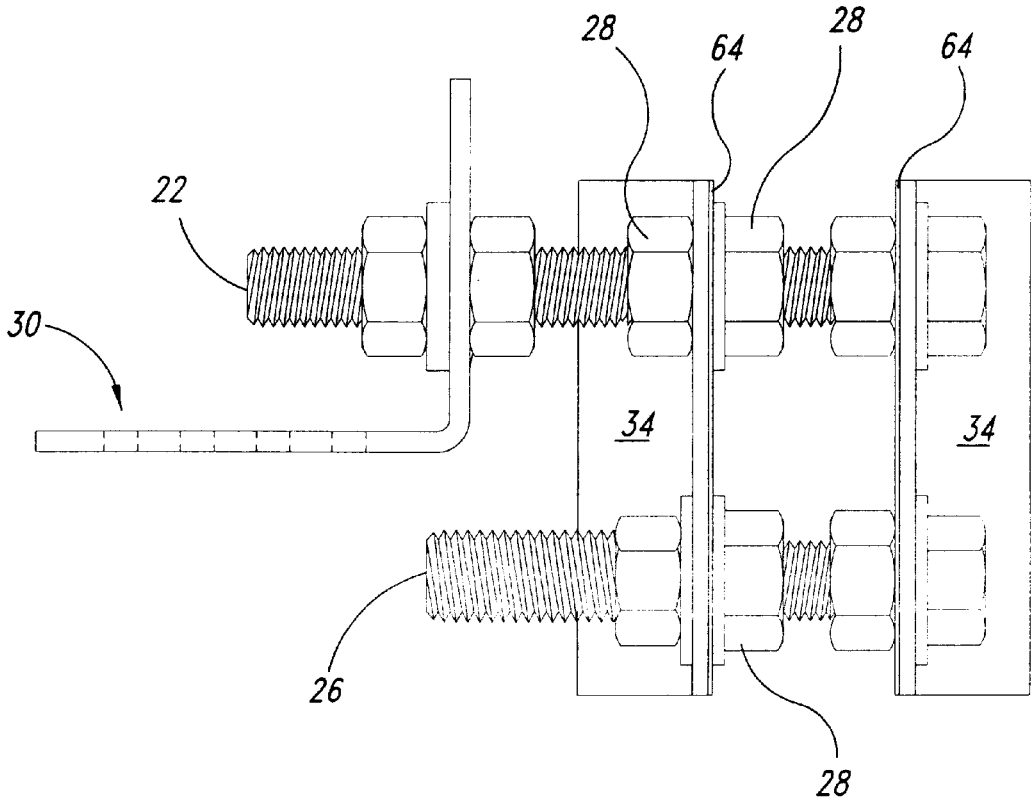
FIG. 6 is a side view of the assembled exhaust throttle of FIG. 5.
Figure 7A:
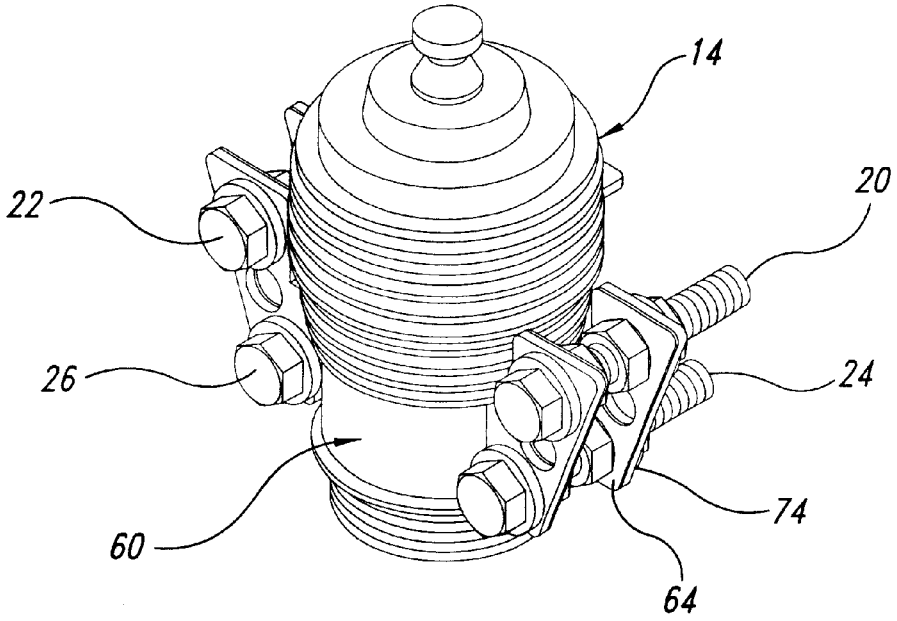
FIGS. 7A and 7B are right and left isometric projections, respectively, of the exhaust throttle assembled on a cylinder in accordance with the second embodiment of the invention.
Figure 7B:
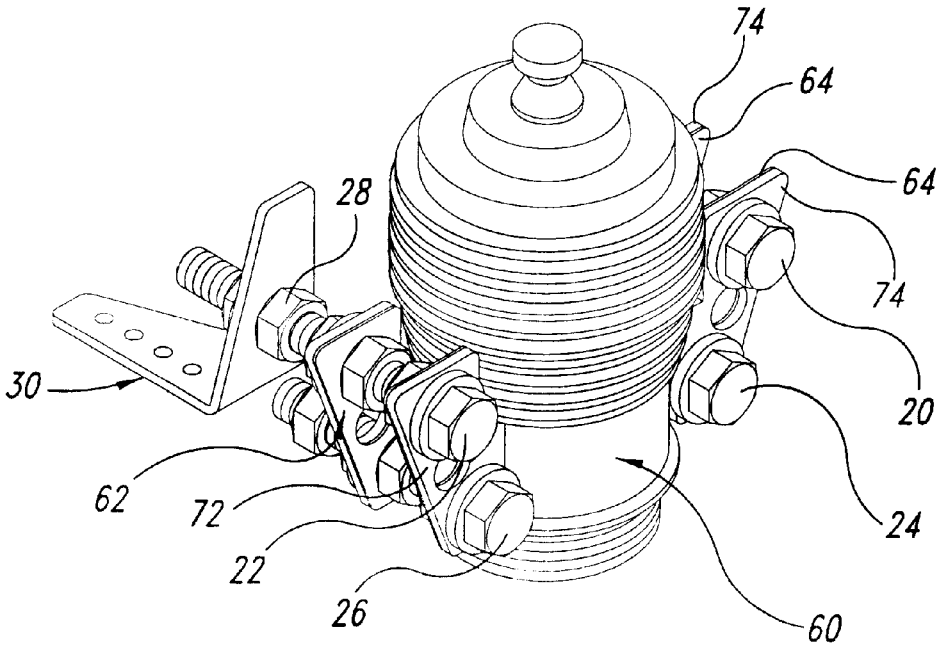

In accordance with another embodiment of the invention, a modified semi-sleeve 60 is provided, as shown in FIGS. 4A–4C. For convenience in referring to the figures, like elements in the first and second embodiments will have the same reference numbers throughout the drawings.

As shown in FIG. 4A, the semi-sleeve 60 includes the rectangular-shaped central section 34 and first and second fastener wings 62, 64 depending from the sides 36, 38 of the central section 34. The fastener wings 62, 64 have a slightly different shape than the fastener horns 40, 42 of the first embodiment illustrated in FIG. 2, although they serve a similar function. Although not shown in FIG. 4A, it is to be understood that openings for fasteners and exhaust vents will be formed in the fastener wings 62, 64 as are shown and described above with respect to the fastener horns 40, 42.

In this second embodiment, the fastener wings 62, 64 are displaced outward from the bend lines 66, shown in phantom. In addition the top portions 68, 70 of the fastener wings 62, 64 have a width that increases outwardly when moving away from the central section 34 instead of decreasing inwardly as do the fastener horns 40, 42.

Shown in FIG. 4B are a pair of wing doublers 72, 74 that are sized and shaped to match the fastener wings 62, 64. These wing doublers 72, 74 will include the same openings as the fastener wings 62, 64 described above, although they are not shown here.

The wing doublers 72, 74 are preferably formed of the same material as the fastener wings 62, 64, which preferably is a material that has a coefficient of thermal expansion that is greater than the coefficient of thermal expansion of the engine cylinder. Ideally a metal material is used, such as brass, although other materials may be used that meet the needs of this application, as will be known to those skilled in the art. Brass is preferred when the cylinder is formed of steel due to the differential between the coefficients of thermal expansion.

FIG. 4C shows the wing doublers 72, 74 attached to the fastener wings 62, 64 in a position that overlays and matches the shapes. As such, the wing doublers 72, 74 will have an extension 76 that extends over the central section 34 to define the bend lines 66, which are the defined sides 36, 38 of the central section 34.

The wing doublers 72, 74 provide reinforcement for the fastener wings 62, 64, enabling the use of thinner material for the semi-sleeve 60. In addition, the wing doublers 72, 74 with the extension 76 aid in holding the semi-sleeve 60 tighter to the cylinder 14, achieving a much lower idle, and they facilitate assembly of the two semi-sleeves 60 without the use of dies.

Figure 8:
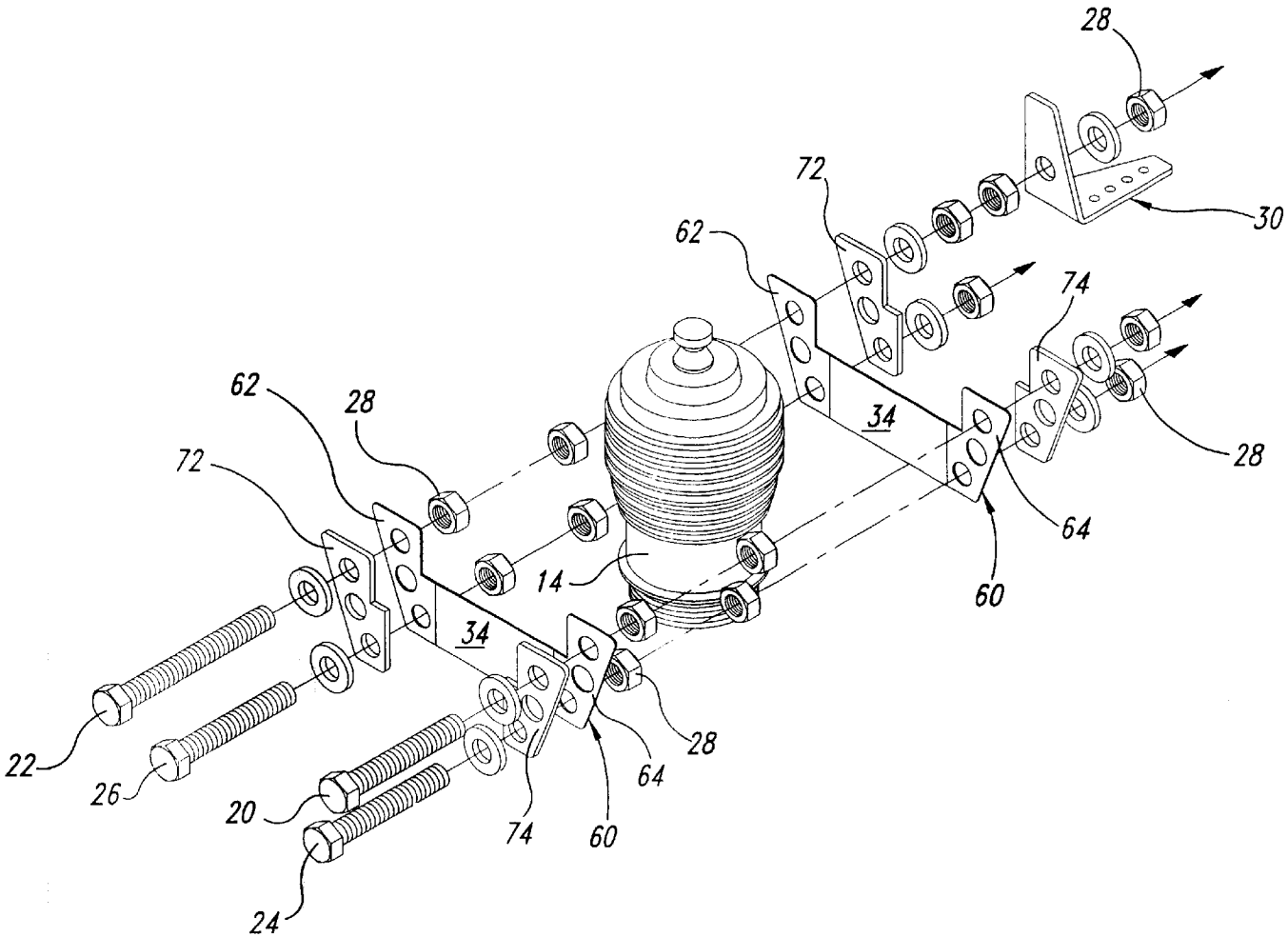
FIG. 8 is an isometric exploded view of the second embodiment of the invention.

FIGS. 5, 6, 7A, and 7B show the semi-sleeves 60 with wing doublers 72, 74 attached to the cylinder 14 in a manner similar to that described above with respect to FIGS. 1 and 3. FIG. 8 is an exploded view of the embodiment of FIGS. 5–7B.

The principles of operation of the second embodiment will now be described. The exhaust throttle system of the present invention utilizes materials, such as metals, having different coefficients of thermal expansion formed into adjustable "non-rigid" bendable or flexible semi-sleeves 60 to enhance idle and full speed RPM performance. It should be noted that "semi-sleeve" as used herein does not mean exactly one-half of a circle, but instead is used to mean a partial or incomplete circle.

The brass semi-sleeves of the embodiment described herein are "dynamic" as opposed to "static" in that they change size by expanding or contracting with changes in throttle setting, which results in changes of the cylinder temperature. This change in size relative to the change in size of the steel cylinder changes the dimension of the gap between the semi-sleeve 60 and the cylinder 14. It is through this gap that exhaust gases can pass, which has been describe above as blowby.

When the engine is running, the semi-sleeves 60 float on a cushion of high-pressure exhaust waves (up to 500/second), which greatly reduces the friction between the semi-sleeve 60 and the cylinder 14, thereby reducing wear on the materials and the amount of force needed to rotate the semi-sleeve 60. This in turn reduces throttle servo load and current drain of the battery in the vehicle.

At full throttle, highest engine temperature is achieved, and the thin, highly flexible semi-sleeves 60 are at a maximum thermal expansion and under the highest exhaust pressure, thereby causing the semi-sleeves 60 to flex outward, away from the cylinder, which increases blowby and sub-piston induction for a substantially increased full speed RPM. Sub-piston induction is the oxygen rich fresh air that enters the crankcase, through the cylinder exhaust ports and under the piston skirt when the piston is at or near top dead center.

The semi-sleeves 60 function as throttle valves to provide controlled dual throttle exhaust (in two exhaust port cylinders). As the semi-sleeves rotate, such as under Radio Control (R/C) with any movement of the transmitter's throttle stick or trim lever, they open or close the cylinder's exhaust ports to increase or decrease throttle port exhaust. As the semi-sleeves 60 expand or contract with changes in temperature, they increase or decrease blowby exhaust and sub-piston induction. This in turn affects the speed of the engine automatically.

The ratio of throttle port exhaust to blowby continually changes as the semi-sleeves 60 progressively open and close the cylinder's exhaust ports. When the semi-sleeves have completely closed off the cylinder's exhaust ports at an idle position, there is no throttle port exhaust, only blowby. As the semi-sleeves 60 rotate from the idle position to the full speed position, the engine's exhaust ports are opened, increasing throttle port exhaust and decreasing blowby, thereby changing the ratio of throttle port exhaust to blowby.

However, it is the total exhaust that determines engine RPM. With the present invention, the engine will reach full speed even with the exhaust ports partially closed because of the additional blowby provided by the semi-sleeves. At idle, although the temperatures are decreased and the semi-sleeve is at it's maximum contraction, the blowby is the greatest because the semi-sleeve is completely covering the cylinder exhaust ports.

At full speed, the semi-sleeves partially cover the cylinder's exhaust ports, which muffles the sound of the engine. As the semi-sleeves rotate from the full speed position to the idle position, progressively covering more of the engine's exhaust port, there is a corresponding progressive increase in the muffling of the engine's sounds.

Thus, the exhaust throttling system provides a vastly superior RPM range compared to the RPM range of conventional air-bleed carburetor throttling. With an idle up to 8,000 RP<lower than the idle RPM of an air-bleed carburetor throttle, even the very smallest and lightest MICRO R/C model plane will have a "park-on-runway" idle, similar to the larger 0.60 engines. It has been found that the terrific back pressure on idle to contain the hot spent combustion gases within the combustion chamber, which keeps the glow plug's platinum element hot to prevent flame-out on idle, achieves an incredibly low idle for very small engines, such as the 0.010 displacement engine.

From the foregoing it will be appreciated that, although specific embodiments of the invention have been described herein for purposes of illustration, various modifications may be made without deviating from the spirit and scope of the invention. Accordingly, the invention is not limited except as by the appended claims and the equivalents thereof.

What is claimed is:

1. An exhaust throttling system for engines having individual cylinders with at least one exhaust port to exhaust combustion gases from the cylinder chamber, comprising:

at least one sleeve configured to be slidably attached to the cylinder and selectively cover and uncover the exhaust port, the at least one sleeve formed of a metal having a coefficient of thermal expansion greater than the coefficient of thermal expansion of the cylinder to expand and contract in response to changes in temperature and change dimension of a gap between the at least one sleeve and the cylinder to change the rate of blowby of exhaust gases.

2. The system of claim 1, wherein the at least one sleeve comprises a central section of a first thickness and first and second wings extending from opposing first and second sides of the central section, the first and second wings formed to have a second thickness greater than the first thickness.

3. The system of claim 2, wherein the first and second wings comprise first and second wing segments integrally formed with the central section and first and second wing doublers configured for attachment to the respective first and second wing segments.

4. The system of claim 1, further comprising a throttle horn attached to one of the at least one sleeves to enable controlled rotation of the at least one sleeve relative to the cylinder.

5. The system of claim 4, wherein the throttle horn is configured to be coupled to an external actuator.

6. An exhaust throttling system for an engine having an individual cylinder with at least one exhaust port to exhaust combustion gasses from the cylinder chamber, the system comprising:

first and second sleeves configured to be attached together to encircle the cylinder and to selectively cover and uncover the exhaust port, the first and second sleeves formed of a metal having a co-efficient of thermal expansion greater than the co-efficient of thermal expansion of the cylinder to expand and contract in response to changes in temperature and to change dimension of a gap between the first and second sleeves and the cylinder to change the rate of blowby of exhaust gasses.

7. An exhaust throttling system for an engine having an individual cylinder with at least one exhaust port to exhaust combustion gasses from the cylinder chamber, the system comprising:

first and second sleeves configured to be attached together to encircle the cylinder and to selectively cover and uncover the exhaust port, the first and second sleeves formed of a metal having a co-efficient of thermal expansion greater than the co-efficient of thermal expansion of the cylinder to expand and contract in response to changes in temperature and to change dimension of a gap between the first and second sleeves and the cylinder to change the rate of blowby of exhaust gasses, the first and second sleeves each having a central section formed to have a first thickness and first and second wings extending from opposing first and second sides of the central section, the first and second wings formed to have a second thickness greater than the first thickness.

8. An exhaust throttling system for an engine having an individual cylinder with at least one exhaust port to exhaust combustion gasses from the cylinder chamber, the system comprising:

first and second sleeves configured to be attached together to encircle the cylinder and to selectively cover and uncover the exhaust port, the first and second sleeves formed of a metal having a co-efficient of thermal expansion greater than the co-efficient of thermal expansion of the cylinder to expand and contract in response to changes in temperature and to change dimension of a gap between the first and second sleeves and the cylinder to change the rate of blowby of exhaust gasses, the first and second sleeves each having a central section formed to have a first thickness and first and second wings extending from opposing first and second sides of the central section, the first and second wings formed to have a second thickness greater than the first thickness, the first and second wings further comprising first and second wing segments integrally formed with the central section and first and second wing doublers configured for attachment to the respective first and second wing segments.

9. A miniature engine, comprising:

at least one cylinder having at least one exhaust port for exhausting gases from a chamber in the cylinder;

at least one sleeve configured to be slideably attached to the cylinder and to selectively cover and uncover the exhaust port, the at least one sleeve formed of a metal having a co-efficient of thermal expansion greater than the co-efficient of thermal expansion of the cylinder to expand and contract in response to changes in temperature and change dimension of a gap between the at least one sleeve and the cylinder to change the rate of blowby of exhaust gases.

10. A miniature engine, comprising:

a cylinder having at least one exhaust port to exhaust combustion gasses from the cylinder;

first and second sleeves configured to be attached together to encircle the cylinder and to selectively cover and uncover the exhaust port, the first and second sleeves formed of a metal having a co-efficient of thermal expansion greater than a co-efficient of thermal expansion of the cylinder to expand and contract in response to changes in temperature and to change dimension of a gap between the first and second sleeves and the cylinder to change the rate of blowby of exhaust gasses.

11. A miniature engine, comprising:

a cylinder having at least one exhaust port to exhaust combustion gasses from the cylinder;

first and second sleeves configured to be attached together to encircle the cylinder and to selectively cover and uncover the exhaust port, the first and second sleeves formed of a metal having a co-efficient of thermal expansion greater than a co-efficient of thermal expansion of the cylinder to expand and contract in response to changes in temperature and to change dimension of a gap between the first and second sleeves and the cylinder to change the rate of blowby of exhaust gasses, the first and second sleeves each having a central section of a first thickness and first and second wings extending from opposing first and second sides of the central section and formed to have a second thickness greater than the first thickness.

12. A miniature engine, comprising:

a cylinder having at least one exhaust port to exhaust combustion gasses from the cylinder;

first and second sleeves configured to be attached together to encircle the cylinder and to selectively cover and uncover the exhaust port, the first and second sleeves formed of a metal having a co-efficient of thermal expansion greater than a co-efficient of thermal expansion of the cylinder to expand and contract in response to changes in temperature and to change dimension of a gap between the first and second sleeves and the cylinder to change the rate of blowby of exhaust gasses, the first and second sleeves each having a central section of a first thickness and first and second wings extending from opposing first and second sides of the central section and formed to have a second thickness greater than the first thickness, the first and second wings comprising first and second wing segments integrally formed with the central section and first and second wing doublers configured for attachment to the respective first and second wing segments.

13. The engine of claim 12, first comprising a throttle horn attached to one of the first and second sleeves to facilitate controlled rotation of the first and second sleeves relative to the cylinder.

14. The engine of claim 13, wherein the throttle horn is configured to be coupled to an external actuator.

15. An exhaust throttle system for an engine having a cylinder with at least one exhaust port to exhaust combustion gasses from the cylinder, comprising:

means for covering the exhaust port of the cylinder, the covering means formed of a metal having a co-efficient of thermal expansion greater than the co-efficient of thermal expansion of the cylinder to expand and contract in response to changes in temperature and to change dimension of a gap between the covering means and the cylinder to change the rate of blowby of exhaust gasses.

16. A method of throttling an engine having an individual cylinder and at least one exhaust port for exhausting gases from a chamber in the cylinder, comprising: forming at least one sleeve of a material having a co-efficient of thermal expansion greater than the co-efficient of thermal expansion of an engine cylinder; attaching the at least one sleeve to a cylinder having an exhaust port for movement around the cylinder; rotating the sleeve on the cylinder to uncover the exhaust port for high-speed operation of the engine, and to cover the exhaust port for idle operation wherein the at least one sleeve expands and contracts in response to increases and decreases in the cylinder temperature, respectively, to alter the dimension of a gap between the at least one sleeve and the cylinder to change the amount of blow-by of exhaust gases between a gap and automatically regulate the speed of the engine.

17. The method of claim 16, wherein forming the at least one sleeve comprises forming first and second sleeves to have a central section of a first thickness and first and second wings extending from opposing first and second sides of the central section to have a second thickness greater than the first thickness.

18. The method of claim 17, wherein the first and second wings are formed to comprise first and second wing segments integrally formed with the central section and first second wing doublers configured for attachment to the respective first and second wing segments.

19. The method of claim 16, further comprising forming a throttle horn attached to one of the at least one sleeves to enable controlled rotation of the at least one sleeve relative to the cylinder.

* * * * *